United States Patent [19]

Croudace

[11] Patent Number: 4,525,174

[45] Date of Patent: Jun. 25, 1985

[54] METHOD AND FUEL COMPOSITION FOR CONTROL OF OCTANE REQUIREMENT INCREASE

[75] Inventor: Michael C. Croudace, Huntington Beach, Calif.

[73] Assignee: Union Oil Company Of California, Los Angeles, Calif.

[21] Appl. No.: 565,986

[22] Filed: Dec. 27, 1983

Related U.S. Application Data

[63] Continuation-in-part of Ser. No. 451,279, Dec. 20, 1982, Pat. No. 4,444,565.

[51] Int. Cl.[3] ..... C10L 1/18

[52] U.S. Cl. ..... 44/68; 44/67; 123/1 A

[58] Field of Search ..... 44/67, 68; 123/1 A

[56] References Cited

U.S. PATENT DOCUMENTS

| | | | |
|---|---|---|---|
| 2,867,516 | 1/1959 | Pedersen | 44/68 |
| 2,875,223 | 2/1959 | Pedersen et al. | 44/68 |
| 2,923,611 | 2/1960 | Wieland | 44/68 |
| 2,948,747 | 8/1960 | Karbum et al. | 44/68 |
| 3,341,311 | 9/1967 | Pedersen | 44/68 |
| 3,353,938 | 11/1967 | Niedzielski | 44/68 |
| 3,535,356 | 10/1970 | Hartle et al. | 44/68 |

*Primary Examiner*—Y. Harris-Smith

*Attorney, Agent, or Firm*—Robert J. Baran; Gregory F. Wirzbicki; Dean Sandford

[57] ABSTRACT

The control of the octane requirement increase phenomenon in a spark ignition, internal combustion engine is achieved by continuously or intermittently introducing with the combustion charge a fuel composition containing (a) an oil-soluble iron compound, (b) a volatile carboxylic acid or ester, and (c) a nonvolatile polar compound capable of solubilizing carbonaceous engine deposits, wherein said nonvolatile polar compound is introduced either simultaneously with said oil-soluble iron compound and said volatile carboxylic acid or ester during the intermission. Preferably said nonvolatile polar compound comprises an oxidation resistant hydrocarbon moiety covalently connected to a polar moiety selected from the group consisting of primary and secondary amino, formamido and sulfo radicals.

60 Claims, No Drawings

METHOD AND FUEL COMPOSITION FOR CONTROL OF OCTANE REQUIREMENT INCREASE

CROSS REFERENCE TO RELATED APPLICATIONS

This application is a continuation-in-part of U.S. patent application Ser. No. 451,279, entitled Method and Fuel Composition For Control of Octane Requirement Increase, filed on Dec. 20, 1982, in the name of Michael C. Croudace, and now U.S. Pat. No. 4,444,565.

BACKGROUND OF THE INVENTION

1. Field of the Invention

This invention relates to improved hydrocarbon fuels which control the octane requirement increase (ORI) phenomenon conventionally observed during the initial portion of the operating life of spark ignition internal combustion engines.

2. Description of the Art

The ORI effect exhibited by the internal combustion engines, e.g., spark ignition engines, is well known in the art. This effect may be described as the tendency for an initially new or clean engine to require higher octane quality fuel as operating time accumulates and is coincidental with the formation of carbonaceous deposits in the region of the combustion chamber of the engine. Thus, during the initial operation of a new or clean engine, a gradual increase in octane requirement (OR), i.e., fuel octane number requirement for knock-free operation, is observed with an increasing buildup of carbonaceous deposits in the combustion chamber until a rather stable or equilibrium OR level is reached, which, in turn, seems to correspond to a point in time where the quantity of deposit accumulation on the combustion chamber and valve surfaces no longer increases but remains relatively constant. This so-called "equilibrium value" is usually reached between about 3,000 and 20,000 miles or corresponding hours of operation. The actual equilibrium value of this increase can vary with engine design and even with individual engines of the same design; however, in almost all cases the increase appears to be significant, with ORI values ranging from about 2 to 14 Research Octane Numbers (RON) being commonly observed in modern engines.

It is also known that additives may either prevent or reduce deposit formation or remove or modify formed deposits in the combustion chamber and adjacent surfaces and hence decrease ORI. Such additives are generally known as octane requirement reduction (ORR) additives.

For example, in U.S. Pat. No. 4,264,335 to Bellow et al. the cerous or ceric salt of 2-ethylhexanoate is disclosed as a useful additive for suppressing the ORI of a gasoline fired internal combustion engine. It is noted in this patent that the above salt has no effect on combustion efficiency of a gasoline and does not provide anti-knock properties.

In U.S. Pat. No. 4,357,148 to Graiff there is disclosed an additive for controlling or reversing the ORI of a spark ignition internal combustion engine which comprises a combination of (a) certain oil-soluble aliphatic polyamines and (b) certain low molecular weight polymers and/or copolymers of mono-olefins having up to 6 carbon atoms. See also U.S. Pat. Nos. 4,270,930 to Campbell et al. and 3,960,515 to Honnen for the use of hydrocarbyl poly(oxyalkylene)aminocarbamates and hydrocarbyl amines, respectively, to control or reverse ORI.

U.S. Pat. No. 3,506,416 to Patinkin et al. discloses an additive to inhibit ORI of a spark ignition engine which comprises a gasoline-soluble metal salt of a hydroxamic acid. This additive is disclosed as useful in leaded gasolines. Although iron is within the broad group of metal salts of hydroxamic acid that are disclosed as a suitable additive for suppression of ORI, no data demonstrating its effectiveness are given. In fact, the patentees point out that nickel and cobalt are especially preferred for their additive.

Other references describing additives for inhibiting ORI include U.S. Pat. Nos. 3,144,311 and 3,146,203 which disclose utilization of nitrogen ring compounds in combination with organometallic primary anti-knock agent and a minor amount of an ignition control additive selected from the group consisting of phosphorus and boron compounds. U.S. Pat. No. 3,864,098 to Honnen also discloses the use of nitrogen ring compounds for the same purpose.

In addition to the above, the following patents are directed to the problem of ORI or deposit control in a spark ignition internal combustion engine:

U.S. Pat. No. 3,996,024 to Coon which discloses monocarboxylic acid salts of hydrocarbyl amines, which function as rust inhibitory and dispersant hydrocarbon fuel additives, wherein the hydrocarbyl substituent contains from 30 to about 300 carbon atoms;

U.S. Pat. No. 3,873,277 to Coon which discloses liquid hydrocarbon distillate fuel compositions comprising a hydrocarbonaceous distillate fuel boiling in a gasoline range containing an aliphatic hydrocarbon substituted hydrazine;

U.S. Pat. No. 4,198,306 to Lewis which discloses hydrocarbylpoly(oxyalkylene)aminoesters which are monoesters of a hydrocarbyl-terminated poly(oxyalkylene) alcohol and a monocarboxylic $C_2$–$C_{20}$(amino-substituted)alkanoic acid useful as fuel and lubricating oil additives;

U.S. Pat. No. 4,234,321 to Lilburn which discloses fuel compositions containing a deposit control additive which is produced by reacting a hydrocarbylpoly(oxyalkylene) alcohol with excess phosgene and an excess amount of certain polyamines to create hydrocarbylpoly(oxyalkylene) ureylene carbamates; and U.S. Pat. No. 4,302,215 to Lewis which discloses hydrocarbyl carbonates useful as deposit control additives in gasoline compositions.

Thus, it is one object of this invention to provide a hydrocarbon fuel containing a novel additive which suppresses the ORI of spark ignited internal combustion engines.

It is another object of the instant invention to reverse the ORI phenomenon in a spark ignition internal combustion engine by introducing a novel additive with the It is another object of the instant invention to provide a two-step method to reverse the ORI phenomenon in a spark ignition internal combustion engine by separately introducing with the fuel a first additive to solubilize carbonaceous deposits in an internal combustion engine and a second additive to inhibit ORI.

It is another object of the instant invention to provide a lead-free liquid hydrocarbon fuel containing a novel additive for inhibiting the ORI of a clean internal combustion engine.

Other objects are to provide new compositions of matter and to advance the art.

Other objects and advantages of the instant invention will become apparent to those skilled in the art from the following description.

SUMMARY OF THE INVENTION

It has now been found that when minor amounts of (a) an oil soluble iron compound and (b) a volatile carboxylic acid and/or ester derivative thereof is used as a gasoline additive in combination with a substantially nonvolatile polar compound, capable of dissolving carbonaceous deposits in an internal combustion engine, a significant reduction in ORI is produced.

Accordingly, the invention provides a method for operating a spark ignition internal combustion engine which comprises continuously or intermittently introducing with the combustion intake charge to said engine an ORI-inhibiting amount of (a) an oil-soluble iron compound, (b) a volatile carboxylic acid and/or an ester derivative thereof, preferably wherein said carboxylic acid is a carboxylic acid having at least two carbons and more preferably an unsubstituted monocarboxylic acid, and either with said fuel composition containing (a) and (b) or during the intermission, in a separate fuel composition, (c) a nonvolatile polar compound capable of solubilizing carbonaceous engine deposits.

The invention further provides a motor fuel composition comprised of a mixture of hydrocarbons which boil in the gasoline range of about 50° C. (122° F.) to about 232° C. (450° F.) containing (a) from about 0.0001 to about 10 grams of iron per gallon introduced as an oil-soluble iron compound, (b) from about 0.001 to about 10 grams per gallon of a volatile carboxylic acid or derivative thereof (preferably wherein the carboxylic acid is a carboxylic acid having at least two carbon atoms and more preferably an unsubstituted monocarboxylic acid) and (c) from about 0.01 to about 10 weight percent of a nonvolatile polar compound capable of solubilizing carbonaceous engine deposits.

Further provided according to the invention is an ORI-inhibiting additive concentrate comprised of (a) from about 0.01 to about 50 grams iron per gallon added as of the above described iron compound, (b) from about 0.1 to about 100 grams per gallon of a volatile carboxylic acid and/or an ester derivative thereof, preferably wherein the carboxylic acid is a carboxylic acid having at least two carbon atoms (more preferably an unsubstituted monocarboxylic acid), (c) from about 1 to about 100 grams per gallon of a nonvolatile polar compound capable of solubilizing carbonaceous engine deposits, and (d) the balance of a fuel compatible diluent boiling in the range from about 50° C. (122° F.) to about 232° C. (450° C.).

DETAILED DESCRIPTION OF THE INVENTION

The oil-soluble iron compounds employed in the invention are themselves well-known in the art. For example, see the oil-soluble iron compounds disclosed in U.S. Pat. Nos. 3,341,311, 3,353,938 and 4,139,349 which are herein incorporated by reference for the disclosure of suitable oil-soluble iron compounds. Additional suitable oil-soluble iron compounds include the iron salts of organic acids such as iron napthanate, iron stearate, and iron oleate, etc. and iron complexes such as iron acetyl acetonate, iron carbonyl, etc.

Preferably, the oil-soluble iron compound is selected from the group consisting of dicyclopentadienyl iron and the substituted derivatives thereof. These materials are generally more available, more stable and safer than the various iron carbonyl complexes disclosed in the art. In particular, it is preferred that the oil-soluble iron carbonyl compound is dicyclopentadienyl iron or a substituted dicyclopentatadienyl iron wherein one or both of the cyclopentadienyl rings may be substituted with one to two lower alkyl groups, e.g. $C_1$ to $C_8$ alkyl groups. Alkyl substituted dicyclopentadienyl iron wherein said alkyl substituents are $C_1$ to $C_3$ alkyl groups are especially preferred. The most preferred oil-soluble iron compound is dicyclopentadienyl iron because of its stability and availability.

Any carboxylic acid or ester derivative thereof that may be volatilized with and solubilized in gasoline may be used in this invention. Carboxylic acids having a single carboxylic group, i.e., monocarboxylic acids and at least 2 carbon atoms but no more than about 10 carbon atoms are preferred. The carboxylic acids having over 10 carbon atoms and the polycarboxylic acids are of marginal volatility and tend to form deposits in the engine. moreover, most dicarboxylic acids increase knocking while the single carbon carboxylic acid (formic acid) tends to be thermally unstable, Therefore these carboxylic acids are not preferred for use in this invention. A $C_2$ to $C_4$ monocarboxylic acid is more preferred for use in this invention, while the most preferred carboxylic acid is acetic acid.

The carboxylic acid will preferably be free from heteroatoms such as sulfur, halogen, etc., i.e., it will include only carbon, hydrogen and oxygen atoms.

Preferably, the carboxylic acid is reacted with an alcohol, e.g. a $C_1$ to $C_{10}$ alcohol, more preferably a $C_1$ to $C_8$ alcohol, and even more preferably a saturated alcohol, to provide an ester. The even more preferred alcohol is a $C_4$ to $C_8$ tertiary alkyl alcohol, e.g., tertiary butyl alcohol. The most preferred ester is tertiary butyl acetate.

The nonvolatile polar compound is herein defined as a solvent for the carbonaceous deposits in the internal combustion engine, which solvent is not substantially vaporized during the combustion of the fuel in the engine. Instead the polar compound (or some product thereof) remains at least partially in the liquid state and at least partially solubilizes and dissolves carbonaceous deposits in the cylinders of the engine. The compounds are basically detergents containing a relatively nonoxidizable "tail," e.g. a hydrocarbon or polyalkylene oxide "tail," and a polar "head." Suitable polar "heads" may be selected from the group consisting of acetoxy, amino, ammonium, carbamido, carbamyl, carbonyl, carboxy, carboxylate, cyano, formamido, formyl, hydrazino, hydroxamino, hydroxy, imino, mercapto, nitro, nitroso, phosphono, phosphonate, sulflamino, sulfamyl, sulfino, sulfinyl, sulfo, sulfonate, thiocyano, etc. radicals. More preferably said polar heads are selected from the group consisting of primary and secondary amino, formamido, and sulfo radicals.

The most common "tail" in these compounds are polybutenes or polyoxyalkylenes (e.g. polyoxyethylenes, polyoxypropylenes, polyoxybutylenes, etc.) of high enough molecular weight to make the entire compounds relatively nonvolatile at the temperature developed in an engine, and, in the case of oxyalkylene "tails," having a sufficient ratio of carbon atoms to oxygen atoms to render the polar compound soluble in the fuel. For example, an average molecular weight for said "tail" may vary from about 200 to about 10,000; preferably from about 500 to about 5,000; e.g. about 1,500. Polybutenes are preferred, being highly branched hydrocarbons which make them quite resistant to oxidation. Moreover the terminal unsaturation makes it easy to prepare polar derivatives of polybutene. A polar group is added to the unsaturation to give the molecule the required detergent qualitites.

Specific examples of polar compounds which are useful in the method and compositions of this invention include: polyisobutenyl phenyl hydrazine, polyisobutenyl hydroxy ethyl hydrazine, polyisobutenyldimethyl hydrazine and the other hydrazines disclosed in U.S. Pat. No. 3,873,277; polyisobutenylethylene diamine, polyisobutenylethylene diamine oxalate, polyisobutenylethylene diamine citrate, polyisobutenylethylene diamine acetate, polyisobutenylethylene diamine lactate, polyisobutenylethylene diamine formate, polyisobutenylethylene diamine carbonate, polypropenyl dimethyl propane diamine acetate, polybutenyl ethylene diamine stearate, polypropenyl N', N-dimethyl tetraethylene pentamine acetate, polyisobutenyl methyl amine stearate and the other monocarboxyl acid salts of hydrocarbyl amines disclosed in U.S. Pat. No. 3,996,024; butylpoly(oxypropylene)N-(2-aminoethyl)-2-aminopropionate, dodecylphenylpoly(oxybutylene) aminopropionate, butylpoly(oxypropylene)N-(3-dimethylaminopropyl)aminoacetate, dodecylphenylpoly(oxybutylene)5-(2-aminoethylamino)valerate, and the other hydrocarbylpoly(oxyalkylene)amino esters disclosed in U.S. Pat. No. 4,198,306; butylpoly(oxypropylene)ureylene aminocarbamate, dodecylphenyl poly(oxybutylene) ureylene aminocarbamate, and the other hydrocarbyl poly(oxyalkylene) ureylene carbamates disclosed in U.S. Pat. No. 4,234,321; and polybutenyl(trimethylol propenyl)carbonate, the reaction product of polybutenylchloroformate and N, N, N', N'-tetra-(2-hydroxypropyl)-ethylenediamine or tetra-(1-hydroxyethyl)-ethylene diamine and the other hydrocarbyl carbonates disclosed in U.S. Pat. No. 4,302,215. (U.S. Pat. Nos. 3,996,024; 3,873,277; 4,198,306; 4,234,321 and 4,302,215 are hereby incorporated by reference for the purpose of describing suitable polar compounds for use in the method and composition of this invention).

The iron content of the fuel of this invention is usually between 0.0001 and 10 grams per gallon. Preferably, the iron content of the fuels of the instant invention will range from about 0.001 to about 5 grams per gallon of fuel. At a level lower than about 0.0001 grams per gallon of fuel, the desired inhibition of the ORI is usually not observed, while iron concentrations of greater than about 10 grams per gallon of fuel are expected to lead to excessive engine wear. The preferred upper level for iron concentration is selected to balance cost of the oil-soluble iron compound with a decreasing benefit by way of inhibition of ORI.

The amount of carboxylic acid and/or derivative thereof which is provided in the fuels of the instant invention will usually be at least about 0.001 grams per gallon of fuel and preferably about 0.001 to about 10 grams per gallon of fuel. The carboxylic acid and/or derivative thereof may be adjusted based on the amount of iron provided in the fuel. For example, from about 5 to about 25 moles of carboxylic acid or derivative thereof may be provided per gram of iron. It is noted that the preferred tertiary alcohol esters have anti-knock properties of their own and therefore greater concentrations are not undesirable provided there is no economic debit. However, to obtain the desired ORI inhibition, no more than about 10 grams of a tertiary alcohol ester per gallon of fuel is necessary.

The amount of the nonvolatile polar compound which is provided in the fuels of the instant invention will usually be at least 0.01 and preferably from about 0.01 to about 10 weight percent and most preferably from 0.5 to 1 weight percent. At the lower limits the solubilization of the carbonaceous deposits is relatively decreased; although adequate to suppress or decrease ORI at the higher limits, the cost burden due the polar compound becomes important.

Suitable liquid hydrocarbon fuels of the gasoline boiling range are mixtures of hydrocarbons having a boiling range of from about 25° C. (77° F.) to about 232° C. (450° F.), and often comprise mixtures of saturated hydrocarbons, olefinic hydrocarbons and aromatic hydrocarbons. Preferred are gasoline blends having a saturated hydrocarbon content ranging from about 40 to about 80 percent volume, an olefinic hydrocarbon content from about 0 to about 30 percent volume and an aromatic hydrocarbon content ranging from about 10 to about 60 percent volume. The base fuel can be derived from straight run gasoline, polymer gasoline, natural gasoline, dimer and trimerized olefins, synthetically-produced hydrocarbon mixtures, thermally or catalytically reformed hydrocarbons, or catalytically or thermally cracked petroleum stocks, and mixtures of these. The hydrocarbon composition and octane level of the base fuel are not critical. Any conventional motor fuel base may be employed in the practice of this invention.

The components (a), (b) and (c), described above, provide an ORR additive, and can be introduced into the combustion zone of the engine in a variety of ways to prevent buildup of deposits or to accomplish reduction or modification of deposits. Thus the ORR additive can be injected into the intake manifold intermittently or continuously, as described, preferably in a hydrocarbon carrier having a final boiling point (by ASTM D86) lower than about 232° C. (450° F.). A preferred method is to add the additive to the fuel. For example, the additive can be added separately to the fuel or blended with other fuel additives and then added to the fuel as a mixed additive.

The most convenient method for inhibiting or reversing the ORI of a spark ignition internal combustion engine is to introduce the oil-soluble iron compound, the volatile carboxylic acid or ester thereof, and the substantially nonvolatile polar compound simultaneously to the engine, e.g. blended in suitable fuel. However in a spark ignition internal combustion engine that has already undergone ORI, the serial introduction of the nonvolatile polar compound to dissolve carbonaceous deposits followed by oil-soluble iron compound and the volatile carboxylic acid or ester derivative thereof to further remove and inhibit the formation of carbonaceous deposits, has been found to be especially effective. The serial mode of reversing the ORI may be conveniently carried out by combusting a tankful, e.g. 15 gallons, of fuel (gasoline) having a concentration of from about 100 to about 1000 grams of the polar compound, in the internal combustion engine during the normal operation of a passenger car or similar vehicle. The following tankful (and subsequent tankfuls) may contain, in combination with a suitable fuel (gasoline), from about 0.001 to about 0.01 grams of iron per gallon of said oil-soluble iron compound and from about 0.01 to about 1 grams per gallon of said volatile carboxylic acid or ester derivative thereof.

It has been found that the ORI may drop from 1.5 to 2 units after the combustion of the fuel containing the nonvolatile polar compound and from 1 to 2 additional units after combustion of from 1 to 10 tankfuls of the fuel comprising the oil-soluble iron compound and the volatile carboxylic acid or ester thereof.

In either the simultaneous or serial introduction of the ORR additive of the instant invention an important advantage is obtained over the prior art method of reversing or inhibiting ORI by solubilizing carbonaceous deposits with polar compounds. In the prior art method the polar compounds are generally utilized at relatively high concentrations and are added to the fuel intermittently. For example, one additive, Techron TM (an alkylphenyl poly(oxyalkylene)-N-(2-aminoethylcarbamate), is recommended to be added to the gasoline no more often than every 1600 miles or approximately every 2-3 fillups. With more frequent use the nonvolatile polar compound (if used at the concentrations recommended for Techron TM ) may dilute the crankcase oil with resulting damage to the engine. Continuous simultaneous use of the three component ORR additive of this invention achieves similar or increased control of the buildup of carbonaceous deposits in the internal combustion engine with a much decreased possibility of diluting the crankcase oil with the nonvolatile polar compound. In the serial mode of introducing the ORR additive of this invention, either a lesser concentration of the polar compound can be used during intermittent introduction or a lesser frequency of use is satisfactory to achieve a reduction in the ORI. Thus the result is again a decreased possibility of diluting the crankcase oil with the nonvolatile polar compound.

The invention further provides a concentrate for use in liquid hydrocarbon fuel in the gasoline boiling range comprising (a) from about 0.01 to about 50 grams of iron per gallon provided by the hereinabove described oil soluble, iron compound, (b) from at least about 0.1 to about 100 grams per gallon of a volatile carboxylic acid and/or an ester derivative thereof, optionally (c) from about 0.01 to 0.2 percent by weight of a dehazer particularly a polyester-type ethoxylated/alkylphenol-formaldehyde resin, (d) from about 1 to about 100 grams per gallon of a nonvolatile polar compound, and (e) the balance of a diluent, boiling in the range from about 50° C. (122° F. ) to about 232° C. (450° F.). Diluents may include hydrocarbons and oxygen-containing hydrocarbons. Suitable oxygen-containing hydrocarbon diluents include, e.g., methanol, ethanol, propanol, methyl tert-butyl ether and ethylene glycol monobutyl ether. The hydrocarbon diluent may be an alkane such as heptane but preferably is an aromatic hydrocarbon, such as toluene or xylene, alone or in a mixture with said oxygen-containing hydrocarbon diluents.

The following example demonstrates the surprising suppression of ORI when utilizing an additive comprising an oil-soluble iron compound in combination with a tertiary ester of a mono carboxylic acid and a nonvolatile polar compound in a fuel for a spark ignited internal combustion engine. This example is meant to be illustrative of the instant invention and not intended to limit the scope of the appended claims.

EXAMPLE

An initially clean 1973 350 CID V8 Chevrolet engine is utilized to test the additive of the instant invention for the reversal of ORI. The engine is initially fueled with Union 76 unleaded regular gasoline until the OR of the engine stabilized. Engine fuel is then switched to Techron TM -doped Union 76 unleaded regular gasoline. The composition of the fuel is 20 oz of Techron TM in 15 gallons of fuel. The engine is rated and the OR is reduced 0.5–1.0 ON. 0.005 g of iron (as dicyclopentadieny iron) per gallon and 0.1 gm/gal of tertiary butylacetate (TBA) doped fuel is then introduced to the engine and the OR of the engine is determined after 100 hours of operation. The resultant OR of the engine is found to be 2–3 ON below the initially stabilized level. This new lower OR persists through the following octane ratings while the engine is run on the dicyclopentadienyl iron/TBA doped fuel.

This combination of additives is unique in that the nonvolatile polar compound initiates the reduction of stabilized OR and the iron/TBA agent continues the reduction and maintains the resulting OR at a new low level. Continued use of the polar compound will also control the octane requirement of the engine; however, prolonged use of the former will severely dilute the crankcase oil leading to possible damage of the engine.

While the invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A method for operating a spark ignition internal combustion engine which comprises continuously or intermittently introducing, with the combustion intake charge to said engine, a fuel composition containing an octane requirement increase-inhibiting amount of (a) an oil-soluble iron compound, (b) a volatile mono carboxylic acid or ester, and (c) a non-volatile polar compound capable of solubilizing carbonaceous engine deposits, wherein said non-volatile polar compound is introduced either simultaneously with said oil-soluble iron compound and said volatile carboxylic acid or during the intermission.

2. The method of claim 1 wherein said oil-soluble iron compound is selected from the group consisting of cyclopentadienyl iron and substituted derivatives thereof.

3. The method of claim 2 wherein said soluble iron compound is selected from the group consisting of cyclopentadienyl iron and $C_1$ and $C_3$ alkyl substituted derivatives thereof wherein one or both of the cyclopentadienyl rings are substituted with one to two alkyl groups.

4. The method of claim 1 wherein said oil-soluble iron compound is dicyclopentadienyl iron.

5. The method of claim 1 wherein said carboxylic acid or ester is selected from the group consisting of the esters of $C_2$ to $C_{10}$ monocarboxylic acids.

6. The method of claim 5 wherein said ester is the derivative of a $C_2$ to $C_4$ monocarboxylic acid and a $C_4$ to $C_8$ tertiary alkyl alcohol.

7. The method of claim 6 wherein said ester is t-butyl acetate.

8. The method of claim 1 wherein said oil-soluble iron compound is dicyclopentadienyl iron and said oxygen-containing compound is t-butylacetate.

9. The method of claim 1 wherein said oil-soluble iron compound is introduced into said engine at a concentration of from at least about 0.0001 to about 10 grams of iron per gallon of said fuel composition.

10. The method of claim 9 wherein said monocarboxylic acid or ester is introduced into said engine at a concentration of from at least about 0.001 to about 10 grams per gallon of said fuel composition.

11. The method of claim 8 wherein dicyclopentadienyl iron is introduced into said engine at a concentration of from at least about 0.001 to about 5 grams of iron and said t-butylacetate is introduced into said engine at a concentration of at least about 0.001 to about 10 grams per gallon of said fuel composition.

12. The method of claim 1 wherein said polar compound comprises a polar radical selected from the group consisting of acetoxy, amino, ammonium, carbamido, carbamyl, carbonyl, carboxy, carboxylate, cyano, formamido, formyl, hydrazino, hydroxamino, hydroxy, imino, mercapto, nitro, nitroso, phosphono, phosphonate, sulfamino, sulfamyl, sulfino, sulfinyl, sulfo, sulfonate and thiocyano radicals.

13. The method of claim 12 wherein said radical is covalently bound to a non-polar hydrocarbyl or polyoxyalkylene radical having an average molecular weight of from about 200 to about 10,000.

14. The method of claim 13 wherein said polyalkylene radical is selected from the group consisting of polyoxypropylene and polyoxybutylene.

15. The method of claim 14 wherein said hydrocarbyl radical is a polybutenyl radical.

16. The method of claim 14 or 15 wherein said polar radical is selected from the group consisting of primary and secondary amino, formamido, and sulfo radicals.

17. The method of claim 12 wherein said polar compound is selected from the group consisting of aliphatic hydrocarbyl substituted hydrazines, monocarboxylic acid salts of hydrocarbylamines, hydrocarbylpoly(oxyalkylene)aminoesters, hydrocarbylpoly(oxyalkylene)ureylenecarbamates, hydrocarbylcarbonates.

18. The method of claim 17 wherein said polar compound is selected from the group consisting of polyisobutenylphenylhydrazine, polyisobutenylhydroxyethylhydrazine, polyisobutenyldimethylhydrazine, polyisobutenylethylenediamine, polyisobutenylethylenediamineoxalate, polyisobutenylethylenediaminecitrate, polyisobutenylethylenediamineacetate, polyisobutenylethylenediaminelactate, polyisobutenylethylenediamineformate, polyisobutenylethylenediaminecarbonate, polypropenyldimethylpropanediamineacetate, polybutenylethylenediaminestearate, polypropenyl N',N-(dimethyltetraethylenepentamine)acetate, polyisobutenylmethylaminestearate, butylpoly(oxypropylene)N-(2-aminoethyl-2-aminopropionate, dodecylphenylpoly(oxybutylene)aminopropionate, butylpoly(oxypropylene)N-(3-dimethylaminoproply)aminoacetate, dodecylphenylpoly(oxybutylene)5-(2-aminoethylamino) valerate, butylpoly(oxypropylene)ureylene aminocarbamate, dodecylphenyl poly(oxybutylene)ureyleneaminocarbamate, polybutenyl(trimethylol propenyl)carbonate, and the reaction product of polybutenylchloroformate and N,N,N',N'-tetra-(2-hydroxypropyl)-ethylenediamine or tetra-(]-hydroxyethyl)-ethylene diamine.

19. The method of claim 1 wherein said non-volatile polar compound comprises an alkyl phenyl poly(oxyalkylene)-N-(2-aminoethylcarbamate).

20. The method of claim 11 wherein said non-volatile polar compound comprises an alkyl phenyl poly(oxyalkylene)-N-(2- aminoethylcarbamate)..

21. A motor fuel composition comprising a mixture of a hydrocarbon of the gasoline boiling range and an octane requirement increase-inhibiting amount of (a) an oil-soluble iron compound, (b) a volatile mono carboxylic acid or ester, and (c) a nonvolatile polar compound capable of solubilizing carbonaceous engine deposits.

22. The composition of claim 21 wherein said oil-soluble iron compound is selected from the group consisting of cyclopentadienyl iron and substituted derivatives thereof.

23. The composition of claim 22 wherein said soluble iron compound is selected from the group consisting of cyclopentadienyl iron and $C_1$ and $C_3$ alkyl substituted derivatives thereof wherein one or both of the cyclopentadienyl rings are substituted with one to two alkyl groups.

24. The composition of claim 21 wherein said oil-soluble iron compound is dicyclopentadienyl iron.

25. The composition of claim 21 wherein said carboxylic acid or ester selected from the group consisting of the esters of $C_2$ to $C_{10}$ monocarboxylic acids.

26. The composition of claim 25 wherein said ester is the derivative of a $C_2$ to $C_4$ monocarboxylic acid and a $C_4$ to $C_8$ tertiary alkyl alcohol.

27. The composition of claim 26 wherein said ester is t-butyl acetate.

28. The composition of claim 31 wherein said oil-soluble iron compound is dicyclopentadienyl iron and said oxygen-containing compound is t-butylacetate.

29. The composition of claim 21 wherein said oil-soluble iron compound comprises from about 0.0001 to about 10 grams of iron per gallon of said fuel composition.

30. The composition of claim 29 wherein said monocarboxylic acid or ester is introduced into said engine at a concentration of from at least about 0.001 to about 10 grams per gallon of said fuel composition.

31. The composition of claim 28 wherein dicyclopentadienyl iron comprises from about 0.001 to about 5 grams of iron and said t-butylacetate comprises from about 0.001 to about 10 grams per gallon of said fuel composition.

32. The composition of claim 31 wherein said polar compound comprises a polar radical selected from the group consisting of acetoxy, amino, ammonium, carbamido, carbamyl, carbonyl, carboxy, carboxylate, cyano, formamido, formyl, hydrazino, hydroxamino, hydroxy, imino, mercapto, nitro, nitroso, phosphono, phosphonate, sulfamino, sulfamyl, sulfino, sulfinyl, sulfo, sulfonate and thiocyano radicals.

33. The composition of claim 32 wherein said radical is covalently bound to a non-polar hydrocarbyl or polyoxyalkylene radical having an average molecular weight of from about 200 to about 10,000.

34. The composition of claim 33 wherein said polyalkylene radical is selected from the group consisting of polyoxypropylene and polyoxybutylene.

35. The composition of claim 34 wherein said hydrocarbyl radical is a polybutenyl radical.

36. The composition of claim 34 or 35 wherein said polar radical is selected from the group consisting of primary and secondary amino, formamido, and sulfo radicals.

37. The composition of claim 32 wherein said polar compound is selected from the group consisting of aliphatic hydrocarbyl substituted hydrazines, monocarboxylic acid salts of hydrocarbylamines, hydrocarbylpoly(oxyalkylene)aminoesters, hydrocarbylpoly(oxyalkylene)ureylenecarbamates, and hydrocarbylcarbonates.

38. The composition of claim 37 wherein said polar compound is selected from the group consisting of polyisobutenylphenylhydrazine, polyisobutenylhydroxyethylhydrazine, polyisobutenyldimethylhydrazine, polyisobutenylethylenediamine, polyisobutenylethylenediamineoxalate, polyisobutenylethylenediaminecitrate, polyisobutenylethylenediamineacetate, polyisobutenylethylenediaminelactate, polyisobutenylethylenediamineformate, polyisobutenylethylenediaminecarbonate, polypropenyldimethylpropanediamineacetate, polybutenylethylenediaminestearate, polypropenyl N',N-(dimethyltetraethylenepentamine)acetate, polyisobutenylmethylaminestearate, butylpoly(oxypropylene)N-(2-aminoethyl-2-aminopropionate, dodecylphenylpoly(oxybutylene)aminopropionate, butylpoly(oxypropylene)N-(3-dimethylaminoproply)aminoacetate, dodecylphenylpoly(oxybutylene)5-(2-aminoethylamino) valerate, butylpoly(oxypropylene)ureylene aminocarbamate, dodecylphenyl poly(oxybutylene)ureyleneaminocarbamate, polybutenyl(trimethylol propenyl)carbonate, and the reaction product of polybutenylchloroformate and N,N,N',N'-tetra-(2-hydroxypropyl)-ethylene-diamine or tetra-(]-hydroxyethyl)ethylene diamine.

39. The composition of claim 21 wherein said nonvolatile polar compound comprises an alkylphenyl poly(oxyalkylene)-N-(2-aminoethyl carbamate).

40. The composition of claim 31 wherein said nonvolatile polar compound comprises an alkyl phenyl poly(oxyalkylene)-N-(2-amino ethyl carbamate).

41. A concentrate suitable for use in a liquid hydrocarbon fuel in the gasoline boiling range comprising (a) an oil-soluble iron compound, (b) a volatile mono carboxylic acid or ester, and (c) a nonvolatile polar compound capable of solubilizing carbonaceous engine deposits, and (d) a fuel compatible diluent boiling in the range of from about 50° C. (122° F.) to about 232° C. (450° F.), wherein said (a), (b) and (c) are present in an amount sufficient to provide octane increase inhibiting-effect to said liquid hydrocarbon fuel.

42. The concentrate of claim 41 wherein said oil-soluble iron compound is selected from the group consisting of cyclopentadienyl iron and substituted derivatives thereof.

43. The concentrate of claim 41 wherein said volatile carboxylic acid or ester is selected from the group consisting of the esters of $C_2$ to $C_{10}$ monocarboxylic acids.

44. The concentrate of claim 41 wherein said monocarboxylic acid or ester is introduced into said engine at a concentration of from at least about 0.001 to about 10 grams per gallon of said fuel composition.

45. The concentrate of claim 42 or 43 wherein said oil-soluble iron compound comprises from about 0.01 to about 50 grams of iron and said volatile carboxylic acid or ester comprises from about 0.1 to about 100 grams per gallon of said fuel composition.

46. The concentrate of claim 41 wherein said polar compound comprises a polar radical selected from the group consisting of acetoxy, amino, ammonium, carbamido, carbamyl, carbonyl, carboxy, carboxylate, cyano, formamido, formyl, hydrazino, hydroxamino, hydroxy, imino, mercapto, nitro, nitroso, phosphono, phosphonate, sulfamino, sulfamyl, sulfino, sulfinyl, sulfo, sulfonate and thiocyano radicals.

47. The concentrate of claim 46 wherein said radical is covalently bound to a non-polar hydrocarbyl or polyoxyalkylene radical having an average molecular weight of from about 200 to about 10,000.

48. The concentrate of claim 47 wherein said polyalkylene radical is selected from the group consisting of polyoxypropylene and polyoxybutylene.

49. The concentrate of claim 48 wherein said hydrocarbyl radical is a polybutenyl radical.

50. The concentrate of claim 48 or 15 wherein said polar radical is selected from the group consisting of primary and secondary amino, formamido, and sulfo radicals.

51. The concentrate of claim 46 wherein said polar compound is selected from the group consisting of aliphatic hydrocarbyl substituted hydrazines, monocarboxylic acid salts of hydrocarbylamines, hydrocarbylpoly(oxyalkylene)aminoesters, hydrocarbylpoly(oxyalkylene)ureylenecarbamates, and hydrocarbylcarbonates.

52. The concentrate of claim 51 wherein said polar compound is selected from the group consisting of polyisobutenylphenylhydrazine, polyisobutenylhydroxyethylhydrazine, polyisobutenyldimethylhydrazine, polyisobutenylethylenediamine, polyisobutenylethylenediamineoxalate, polyisobutenylethylenediaminecitrate, polyisobutenylethylenediamineacetate, polyisobutenylethylenediaminelactate, polyisobutenylethylenediamineformate, polyisobutenylethylenediaminecarbonate, polypropenyldimethylpropanediamineacetate, polybutenylethylenediaminestearate, polypropenyl N',N-(dimethyltetraethylenepentamine)acetate, polyisobutenylmethylaminestearate, butylpoly(oxypropylene)N-(2-aminoethyl-2-aminopropionate, dodecylphenylpoly(oxybutylene)aminopropionate, butylpoly(oxypropylene)N-(3-dimethylaminoproply)aminoacetate, dodecylphenylpoly(oxybutylene)5-(2-aminoethylamino) valerate, butylpoly(oxypropylene)ureylene aminocarbamate, dodecylphenyl poly(oxybutylene)ureyleneaminocarbamate, polybutenyl(trimethylol propenyl)carbonate, and the reaction product of polybutenylchloroformate and N,N,N',N'-tetra-(2-hydroxypropyl)-ethylene-diamine or tetra-(]-hydroxyethyl)-ethylene diamine.

53. The concentrate of claim 41 wherein said nonvolatile polar compound comprises an alkylphenyl poly(oxyalkylene)-N-(2-aminoethyl carbamate).

54. The concentrate of claim 45 wherein said nonvolatile polar compound comprises an alkyl phenyl poly(oxyalkylene)-N-(aminoethyl carbamate).

55. The concentrate of claim 54 wherein said oil-soluble iron compound is dicyclopentadienyl iron and said carboxylic acid or ester is t-butylacetate.

56. The concentrate of claim 41 wherein said diluent is selected from the group consisting of hydrocarbons boiling in the range of from about 50° C. to about 232° C.

57. The concentrate of claim 56 wherein said hydrocarbon is an aromatic hydrocarbon.

58. The method of claim 1 wherein said nonvolatile polar compound is introduced during said intermission in a separate fuel composition.

59. The method of claim 1 wherein said nonvolatile polar compound is introduced simultaneously with said fuel composition containing (a) and (b).

60. A method for operating a spark ignition internal combustion engine which comprises continuously or intermittently introducing, with the combustion intake charge to said engine, a fuel composition containing an octane requirement increase inhibitng amount of (a) an oil-soluble iron compound, (b) a volatile monocarboxylic acid or ester, and (c) a nonvolatile polar compound capable of solubilizing carbonaceous engine deposits.

* * * * *